United States Patent [19]

van der Linden

[11] 4,343,113

[45] Aug. 10, 1982

[54] ABRADING DEVICE

[75] Inventor: Jacob A. van der Linden, Kapellen, Belgium

[73] Assignee: Machinefabriek A. van der Linden. B.V., Goes, Netherlands

[21] Appl. No.: 121,826

[22] Filed: Feb. 15, 1980

[30] Foreign Application Priority Data

Mar. 30, 1979 [NL] Netherlands ..... 7902493

[51] Int. Cl.[3] ..... B24B 21/04

[52] U.S. Cl. ..... 51/137; 51/141; 51/215 E; 51/273; 144/245 A; 144/249 B

[58] Field of Search ..... 51/76 R, 110, 135 R, 51/135 BT, 137, 138, 141, 215 E, 273; 144/245 A, 249 B; 198/725, 811

[56] References Cited

U.S. PATENT DOCUMENTS

| | | | |
|---|---|---|---|
| 2,456,217 | 12/1948 | Rothrock | 51/138 |
| 2,901,870 | 9/1959 | Zirbel | 51/137 |
| 3,170,272 | 2/1965 | Burnham | 51/141 |
| 3,266,197 | 8/1966 | Olton | 51/137 |
| 3,549,004 | 12/1970 | Zysman | 198/811 |
| 3,684,081 | 8/1972 | Matsuo | 198/811 |
| 3,686,798 | 8/1972 | CoPresti | 51/138 |
| 4,231,193 | 11/1980 | Siegel | 51/141 |

FOREIGN PATENT DOCUMENTS

| | | | |
|---|---|---|---|
| 1577361 | 1/1970 | Fed. Rep. of Germany | 51/138 |
| 2825045 | 12/1978 | Fed. Rep. of Germany | 198/811 |
| 54-102687 | 8/1979 | Japan | 51/137 |
| 1291115 | 9/1972 | United Kingdom | 198/811 |

*Primary Examiner*—Stephen G. Kunin
*Assistant Examiner*—Robert P. Olszewski
*Attorney, Agent, or Firm*—Diller, Ramik & Wight

[57] ABSTRACT

A device for abrading objects comprising a supporting surface for the object, abrading means operative near the supporting surface and a driven, endless conveyor belt arranged at a distance above the supporting surface, whereas the lower run of the belt is pressed upon the object, wherein the device is provided with a suction cabinet supported by the frame of the conveyor belt and having suction apertures turned towards the top side of the lower run for drawing the lower run against the suction cabinet; the cabinet is connected through a conduit with an outlet channel for conducting away chips.

3 Claims, 4 Drawing Figures

FIG. 1
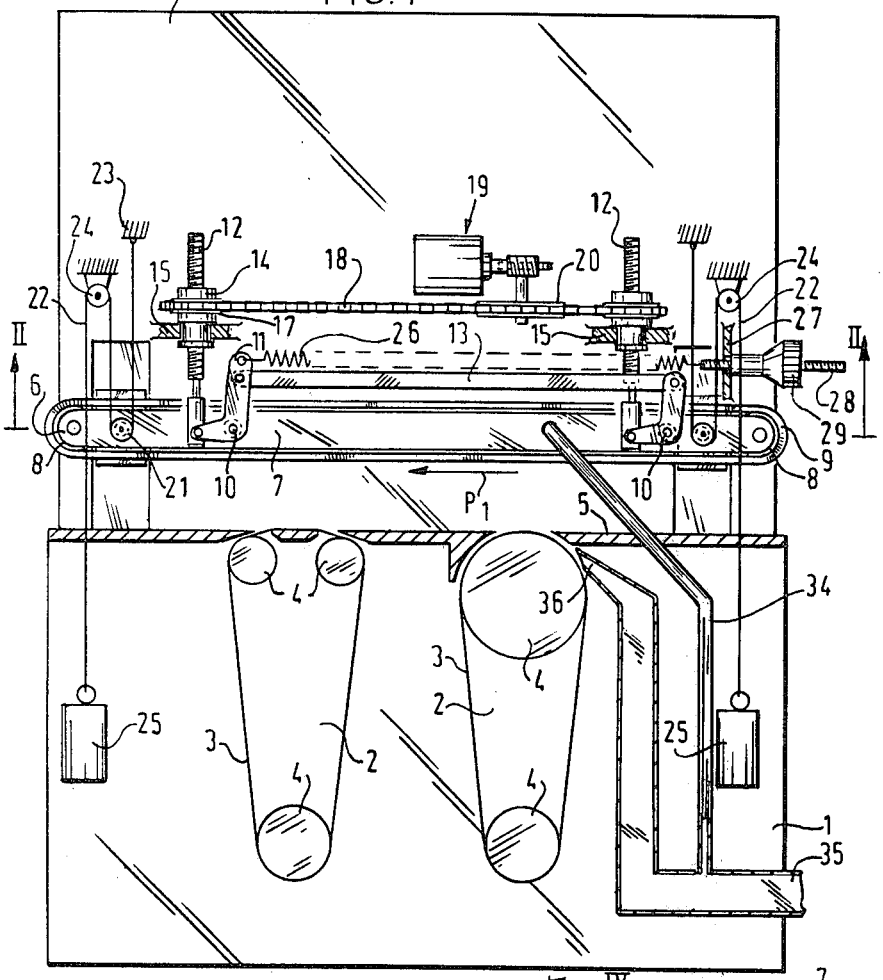
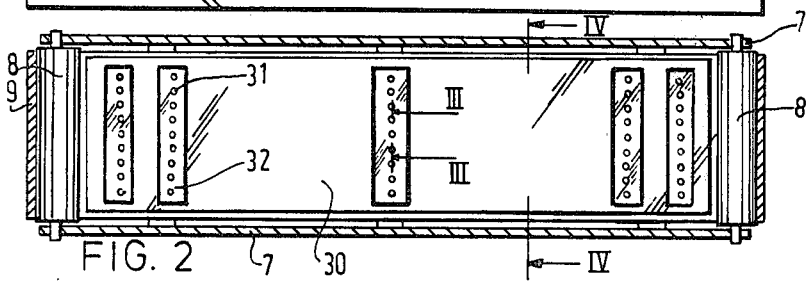
FIG. 2
FIG. 3
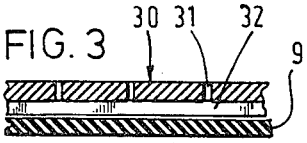
FIG. 4
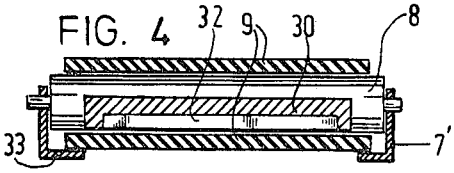

ABRADING DEVICE

The invention relates to a device for abrading the objects comprising a supporting surface for the object, abrading means operative near said supporting surface and a driven, endless conveyor belt arranged at a distance above said supporting surface, the lower run of said belt pressing against the object.

Abrading machines comprising a conveyor belt located above the object involve the problem that the lower run tends to sag. One of the solutions for this problem consists in stretching the belt, but nevertheless after some time said lower run again tends to sag.

The invention has for its object to obviate the aforesaid disadvantage and proposes to this end to equip the device with a suction cabinet supported by the frame of the conveyor belt and having suction apertures turned towards the top side of the lower run for drawing the lower run against the suction cabinet.

With the exception of the parts located opposite the abrading means the suction surface of the cabinet preferably has chambers in which the suction apertures open out.

In this way a uniform suction force is exerted on the lower run of the belt.

If the abrading device is equipped with a nozzle arranged near the abrading means and communicating through an outlet channel with a source of subatmospheric pressure for conducting away chips, the invention proposes to connect the suction cabinet through a conduit with the outlet channel at a point thereof lying at a distance from the nozzle. Owing to this disposition the subatmospheric pressure of the suction cabinet can be derived in a very simple manner from the subatmospheric pressure prevailing in the outlet channel for conducting away the chips. This provides a high economy of energy for such an abrading device.

In order to be able to rapidly draw the lower run of the conveyor belt against the suction cabinet, when the device is put into operation, without appreciable loss of suction air, the invention proposes to hold the edges of the lower run in guiding profiles connected with the suction cabinet.

The invention will be described more fully with reference to an embodiment.

The drawing shows in

FIG. 1 schematical vertical sectional view of an abrading device,

FIG. 2 a bottom view of a suction cabinet used with the conveyor belt shown in FIG. 1, FIG. 3 a sectional view taken on the line III—III in FIG. 2, FIG. 4 a sectional view taken on the line IV—IV in FIG. 2.

The device mainly comprises a box-shaped substructure 1 and two abrading belt aggregates 2 arranged therein. The abrading belt aggregates comprise endless abrading belts 3 passed in known manner around drive and guide rollers 4. The disposition of the abrading belt aggregates with respect to the substructure 1 is such that at the top side the belts just emerge above the supporting surface 5 of the substructure 1, so that an abrading surface becomes available. At a distance above the abrading belt aggregates 2 is arranged a pressure table 6 comprising a supporting frame 7, in which rollers 8 are arranged for guiding an endless belt 9. The rollers 8 are directly driven by a motor (not shown) in the framework 7 so that on the lower side the belt is driven in the direction of the arrow P1.

At the front and at the rear the framework 7 is provided with two stub shafts 10 about which angular levers 11 are pivotable. One end of the angular lever 11 is pivotally connected with the lower end of screw spindle 12, whereas the other limbs of the angular levers 11 are interconnected by a coupling rod 13 on the same side of the framework 7.

The screw spindles 12 co-operate with a screw-like body 14 having inner screwthread and being rotatably supported in an eyelet 15 of a cabinet-like superstructure 16. The rotatable body 14 is provided with a sprocket wheel 17, around which a chain 18 is passed, which is furthermore passed to the sprocket wheel 17 of the second screw spindle 12 arranged at a distance in the superstructure.

The chain 18 can be reciprocated by a chain drive 19 comprising a motor supported in the superstructure 16, said motor driving a sprocket wheel 20 through an orthogonal transmission.

On both sides the framework 7 is provided with rotatably fastened discs 21, around which a passed a flexible element, for example, a rope or chain 22; at one end 23 this flexible element is fastened to the superstructure 16 and is furthermore guided along a disc 24 also fastened to the superstructure 16 to a compensation weight 25 in the lower side of the substructure 1.

It should finally be noted that the other limb of one of the angular levers 11 is provided with a fastening eyelet with which is coupled a tensile spring 26 which bears on a plate 27 connected with the superstructure 16. Through the plate 27 is passed a screw spindle 28 to which the tensile spring 26 is fastened. This screw spindle 28 is provided with a control-knob 29 screwed thereon, the left-hand surface of which bears on the plate 27.

According to one feature of the invention a suction cabinet 30 is arranged above the lower run of the conveyor belt 9 and between the framework 7, FIG. 2 showing the lower side of said cabinet. The lower side has suction apertures 31, which in the embodiment shown open out in chambers 32 recessed in said lower side (see also FIG. 3). These chambers extend substantially over the whole width of the suction cabinet 30 in a direction transverse of the direction of movement of the belt 9. The chambers ensure a uniform subatmospheric pressure above the lower run of the belt 9 so that the lower run is effectively held against the lower side of the suction cabinet 30 when the subatmospheric pressure is prevailing.

FIG. 2 clearly shows that no suction apertures 31 or chambers 32 are provided in those parts of the lower surface of the suction cabinet 30 which are located opposite the abrading belt aggregates 2 in order to ensure a uniform pressure of the work piece on the abrading belts.

FIG. 4 shows an embodiment in which the edges of the framework 7 are provided on the lower side with horizontal flanges 33 extending beyond the side edges of the belt 9. When the device is out of operation and no subatmospheric pressure prevails in the suction cabinet 30, the lower run of the belt tends to sag. In order to limit this phenomenon the flanges 33 are provided so that when the device is again put into operation and subatmospheric pressure is again prevailing in the suction cabinet 30, the space between the lower run of the belt and the suction cabinet 30 will not be excessively large, as a result of which an effective contact with the lower run is ensured.

In the embodiment shown the subatmospheric pressure in the suction cabinet 30 is obtained by connecting this suction cabinet 30 through a conduit 34, for example, a flexible conduit with a chip outlet channel 35. At the right-hand abrading belt aggregate 2 the outlet channel 35 is provided with a nozzle 36 for directly conducting away chips from the belt, whilst the outlet channel 35 furthermore communicates with a subatmospheric pressure source. According to a further feature of the invention the flexible conduit 34 is connected at a point of the outlet channel 35 located at a distance from the nozzle 36 so that an effective subatmospheric pressure in the suction box 30 is guaranteed.

What is claimed is:

1. An abrading device comprising, in combination:

a work support surface having abrading means protruding thereabove at a particular location;

a conveyor assembly located in spaced relation above said surface and defining a guide channel therewith whereby a workpiece is guided and conveyed through said channel, said conveyor assembly comprising a framework, roller means supported by said framework, an endless conveyor belt trained over said roller means to present upper and lower flights in which the lower flight is essentially parallel with said work support surface, means for driving said roller means, and a guide plate overlying said lower flight whereby a workpiece forces said lower flight upwardly against said guide plate, said guide plate having a flat and smooth undersurface in that portion thereof registered above said particular location whereat said abrading means is located, and said undersurface of the guide plate having transverse recesses at locations other than in registry above said particular location, and means for subjecting said recesses to a source of negative pressure whereby said lower flight is maintained up against said undersurface of the guide plate even when a workpiece does not so force it.

2. An abrading device as defined in claim 1 including nozzle means arranged near said abrading means and communicating through an outlet channel with a source of subatmospheric pressure for conducting away the chips, said means for subjecting said recesses to a source of negative pressure comprising a conduit connected to said outlet channel at a point of said channel located at a distance from said nozzle means.

3. An abrading device as defined in claim 1 or 2 including guide profiles depending from said guide plate and embracing the edges of said lower flight to support said lower flight in close proximity below said guide plate when the negative pressure is not present in said recesses.

* * * * *